United States Patent [19]

Hamamura

[11] Patent Number: 4,549,597

[45] Date of Patent: Oct. 29, 1985

[54] METHOD OF MANUFACTURING DURABLE METAL MOLDS BY METAL MELT-SPRAYING

[76] Inventor: Masuzo Hamamura, 10-10, Higashiawaji 2-chome, Higashiyodogawa-ku, Osaka-shi, Osaka-fu, Japan

[21] Appl. No.: 532,567

[22] Filed: Sep. 15, 1983

[30] Foreign Application Priority Data

Sep. 16, 1982 [JP] Japan ..... 57-161998
Jul. 27, 1983 [JP] Japan ..... 58-137955

[51] Int. Cl.[4] ..... B22D 9/02; B22D 23/00
[52] U.S. Cl. ..... 164/35; 164/46
[58] Field of Search ..... 164/44, 45, 46, 34, 164/35, 36

[56] References Cited

U.S. PATENT DOCUMENTS 2,495,276 1/1950 Milton, Jr. ..... 164/35
3,496,987 2/1970 Peterson et al. ..... 164/34

*Primary Examiner*—Nicholas P. Godici
*Assistant Examiner*—Kenneth F. Berg
*Attorney, Agent, or Firm*—Birch, Stewart, Kolasch & Birch

[57] ABSTRACT

A method of manufacturing durable metal molds whereby metal melt-spraying is utilized. The method comprises the steps of spraying a first model with a low melting point metal, removing the first model, casting a second low melting point metal into the space vacated by removal of the first model to form a second model, removing the second model, spraying the second model with a high melting point metal, melting said second model out of the mold formed by spraying the high melting point metal, reinforcing the space vacated by the melting of the second model with sand, and reinforcing the space to the rear of the mold with metal, cement, or any suitable material. The sand is subsequently removed to form a durable metal mold.

19 Claims, 11 Drawing Figures

METHOD OF MANUFACTURING DURABLE METAL MOLDS BY METAL MELT-SPRAYING

BACKGROUND OF THE INVENTION

The present invention generally relates to metal melt-spraying and more particularly, to a method of manufacturing high precision metal molds superior in durability through utilization of a metal melt-spraying technique at ambient temperature as disclosed, for example, in Japanese Patent Publication Tokkosho 47-24859.

In the conventional methods of manufacturing metal molds by utilizing metal melt-spraying, for example, a model for a desired product is first prepared by gypsum or the like, and after spraying molten metal onto the surface of the model, said model is released to form a shell made of a layer of the sprayed metal, with the shell being further backed up or lined so as to prepare the metal mold.

The metal molds thus obtained by the known method as described above, however, have such disadvantages that they are not only inferior in durability, but tend to be subjected to strain or distortion during manufacture, and thus, it is difficult to obtain metal molds having accurate dimensions, with the finished metal molds requiring further repairing or corrections. Therefore, metals having a sufficient hardness can not be employed for the purpose, and the resultant metal mold thus obtained has been generally weak in strength and suitable only for manufacturing trial products at most.

The method of manufacturing metal molds through employment of the metal melt-spraying technique (referred to as ambient temperature metal spraying hereinbelow) disclosed in Japanese Patent Publication Tokkosho 47-24859 referred to earlier (or U.S. Pat. No. 3,901,441), has the drawbacks as described above, in spite of the advantages that metal molds of complicated configurations may be produced through a simple procedure in a short period of time with a consequent low cost. As a result of various tests and researches, it has been made clear that such drawbacks are attributable to the fact that heat storing action is present during the process in which metallic particles flying at ultra high speeds are accumulated to form a layer, while a blasting action is produced as the metallic particles at high speeds collide with each other, and thus, it is difficult on the whole to avoid generation of distortion or to remove the distortion thus formed, with the desired dimensions not being readily achieved. Moreover, since the metallic layer itself obtained here is not very high in strength, reinforcement thereof is necessary, but there has been developed no effective means for achieving the reinforcing effect without generation of distortion.

SUMMARY OF THE INVENTION

Accordingly, an essential object of the present invention is to provide an improved method of manufacturing durable metal molds by a metal melt-spraying process through utilization of merits and substantial elimination of disadvantages inherent in the conventional methods of this kind.

Another important object of the present invention is to provide a metal mold superior in durability and having sufficient strength and accuracy similar to those of ordinary metal molds which may be obtained by cutting metallic blocks.

In accomplishing these and other objects, according to one preferred embodiment of the present invention, there is provided a method of manufacturing durable metal molds by metal melt-spraying, which comprises the steps of placing a model made of an easily processable material such as wood, gypsum, plastic and the like in a steel frame, spraying a low melting point metal such as zinc or its alloy onto the surface of said model at ambient temperature, thereafter forming an inverted mold made of the metal sprayed layer by removing said model, pouring a molten low melting point metal of tin, bismuth, indium or the like into a concave portion of said inverted mold, removing the low melting point metal from the inverted mold after cooling and solidification to prepare a second model, subsequently fixing the second model on a surface plate made of any easily processable metal by a suitable means, further surrounding the peripheral portion of said second model by a steel frame or mold base, subsequently spraying a high melting point metal such as nickel, stainless steel or the like onto the second model at ambient temperature so as to form on the surface of the second model and surrounding portions thereof, a metal sprayed layer in the thickness of approximately 10 to 30 mm, heating the structure thus obtained at temperature sufficient for the second model to melt so as to remove the second model through melting, thereby to obtain a metal mold original which is in integral structure of the steel frame and high melting point sprayed metal layer shell, filling a mixture of sand and sodium silicate into a concave space of said high melting point metal layer shell and supplying carbon dioxide gas thereinto for solidification of said mixture, backing up a space at a back side of the said shell by suitable means such as a molten metal, metal sprayed layer or the like, with a cooling water pipe being embedded in said backing up layer, and finally removing solid sand lump which is filled in said concave space of said shell, with a subsequent polishing of the inner face of said shell for finishing depending on necessity.

By the steps according to the present invention as described above, an improved method of manufacturing durable metal molds through metal melt-spraying has been advantageously presented.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
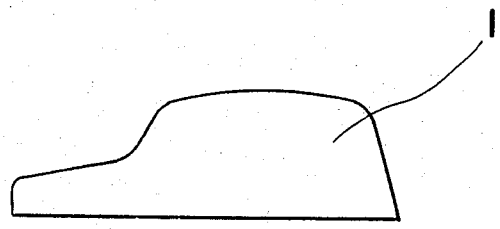
FIG. 1 is a schematic front elevational view of a first model to be employed in a method of manufacturing durable metal molds through utilization of metal melt-spraying according to one preferred embodiment of the present invention.

Before the description of the present invention proceeds, it is to be noted that like parts are designated by like reference numerals throughout the accompanying drawings.

Referring now to the drawings, a method of manufacturing metal molds according to one preferred embodiment of the present invention will be explained in detail hereinbelow (FIGS. 1 to 5).

In the first place, a model 1 for a product in object (referred to as first model hereinbelow) is prepared by an easily processable material, for example, wood, gypsum, plastic or the like as shown in FIG. 1.

Figure 2:
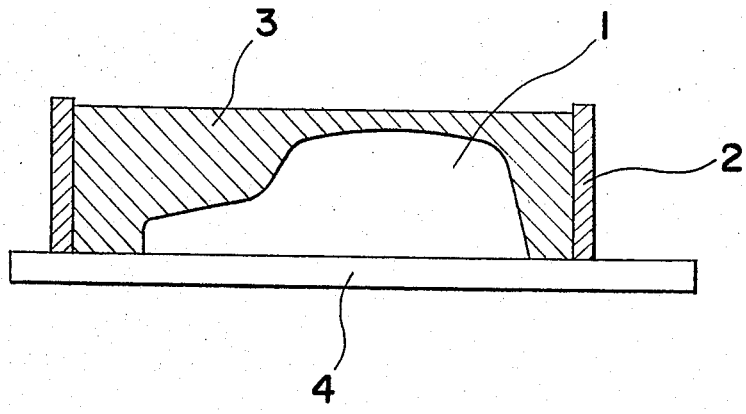
FIG. 2 is a side sectional view showing a state in which metal is sprayed onto the surface of the first model of FIG. 1.

Subsequently, the first model 1 thus prepared in surrounded by a frame 2 made, for example, of steel, and the surface and peripheral portions of the first model 1 are subjected to the ambient temperature metal spraying with use of a metal melting at low temperatures such as zinc, aluminum or alloys thereof, thereby to form a sprayed metal layer 3 as shown in FIG. 2. In the above case, it is preferable that all the materials referred to above are placed on a base 4 for the processing as described above.

Figure 3:
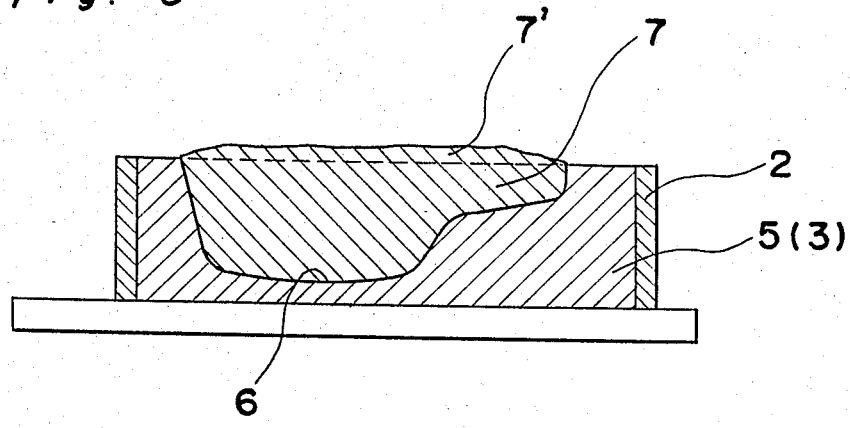
FIG. 3 is a side sectional view for explaining the state in which a molten low melting point metal is poured into a shell obtained by the metal spraying process in FIG. 2.

In the next step, by removing the first model 1 from the sprayed metal layer 3 thus formed, an inverted mold 5 of the first model 1 is obtained. Into a concave space 6 of the inverted mold 5, a molten low melting point metal 7 mainly composed of tin, bismuth, indium or the like is poured as shown in FIG. 3, and after cooling of the low melting point metal 7, an extra portion 7' thereof rising upwardly is scraped off for leveling on its upper surface, and thereafter, the low melting point metal portion 7 is released from the sprayed metal layer 3 so as to obtain a model of the low melting point metal having exactly the same shape as the first model (such a model is referred to as a second model 7 hereinbelow).

Figure 4:
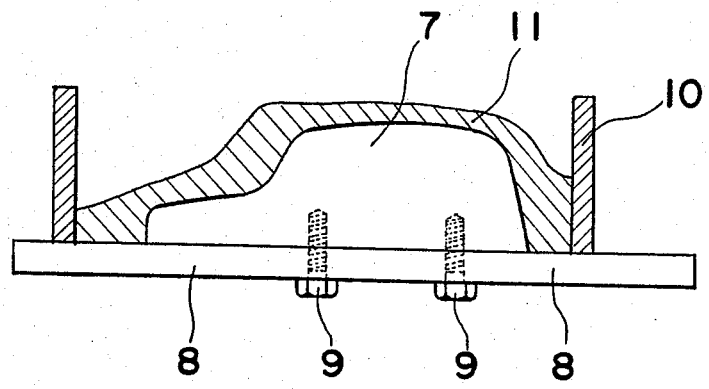
FIG. 4 is a side sectional view showing the state in which a second model is fixed on a surface plate, with a hard metal being sprayed on its surface.

Subsequently, as shown in FIG. 4, the second model 7 is fixed on a surface plate 8 made of any readily processable material, for example, an alloy of the same quality as that for the second model 7, zinc, aluminum, copper or alloys thereof. For the fixing, any method such as clamping by bolts 9 may be employed as shown.

After securing as described above, the second model 7 is surrounded by a steel frame 10 (or a mold base), and in this state, a high melting point metal, for example, nickel, stainless steel or the like is sprayed at ambient temperature onto the surface of the second model 7 and its peripheral portions to form a high melting point metal sprayed layer 11 of approximately 10 to 30 mm in thickness.

Moreover, by subjecting the whole structure as shown in FIG. 4 to heat treatment at such a temperature as is sufficient for the second model 7 made of the low melting point metal to melt (approximately 200° C.), for example, in a furnace, the second model 7 is removed through melting, with simultaneous removal of the surface plate 8 and bolts 9, etc., and thus, a structure in which the high melting point metal sprayed layer 11 (referred to as a hard metal shell 11 hereinbelow) is integrally combined with the steel frame 10, is obtained. In the above case, the hard metal shell 11 is detached from the steel frame 10 so as to be again mounted on a mold base 10' (if such mold base is initially employed, the re-mounting is not required).

Figure 5:
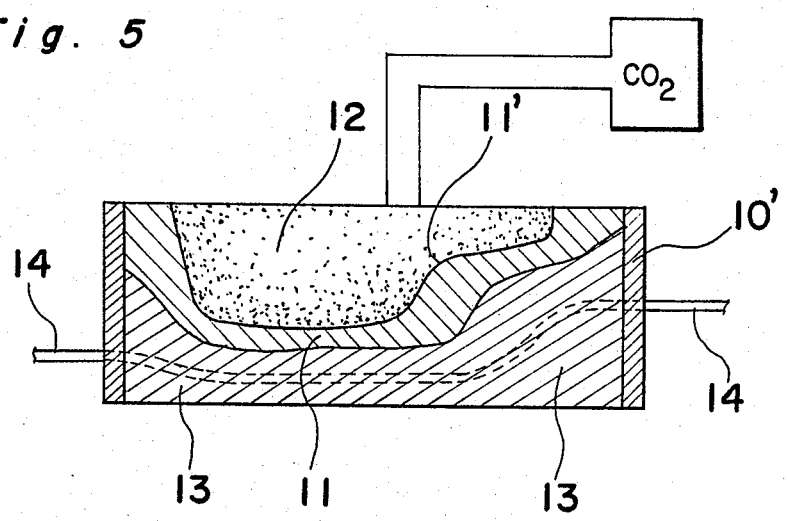
FIG. 5 is a side sectional view showing the state in which a solid sand lump is formed in a concave space of the hard metal shell, with the shell being backed up at its rear side space.

Into a concave space 11' of the hard metal shell 11 thus fixed to the mold base 10', a mixture of sand and sodium silicate is filled, through which carbon dioxide gas is blown for solidification to form a solid sand lump 12 (FIG. 5). Subsequently, the space at the rear side of the hard metal shell 11 is backed up or supported as at 13 by spraying suitable metals such as zinc, aluminum or alloys thereof at ambient temperatures, or pouring molten metals thereinto, or pouring cement, etc. depending on necessity. It is preferable that a pipe 14 for cooling water is embedded in the backed up portion 13. Finally, the solid sand lump 12 hardened in the hard metal shell 11 is destroyed and removed, and the concave face of the hard metal shell 11 thus obtained is subjected to suitable processing such as polishing, etc., whereby the metal mold is completed.

It should be noted here that in the foregoing embodiment, although the steel frame 10 or mold base has been described as employed, such steel frame or mold base should preferably be used for convenience in handling semi-finished products in the manufacturing process of the metal molds and convenience in work, and the employment thereof itself is not indispensable for the method of manufacturing metal molds according to the present invention. After completion, the metal mold according to the present invention is again mounted on a mold base in the similar manner as in the metal molds in general.

The method of manufacturing metal molds according to the present invention has for its contents, the processing as described above, i.e. continuity of processing, and the metal molds thus obtained are high in accuracy to present precise configurations, with superior durability and can be quickly manufactured at low cost. More specifically, in the method of manufacturing metal molds according to the present invention as described above, it will be readily understood in the first place that the first model to be prepared by the easily processable material as stated above may be readily prepared in a short period of time, however precise or complicated in shape it may be. In the second place, since most of the steps in the method of the present invention are composed of simple work, i.e. the manufacturing of the inverted mold by the ambient temperature metal spraying or the back up thereof, with only addition thereto of the casting process of the second model, neither elaborate machines nor operations and techniques requiring skillfulness are necessary, and therefore, it will be understood that the metal molds are manufactured in a short time at low cost.

It is well known that the sprayed metal layer by the ambient temperature metal spraying is capable of faithfully reproducing even extremely minute configurations on the surface of the model, and the inverted model 5 from the first model 1 very correctly reproduces the fine details of the first model. Meanwhile, the second model to be obtained from this inverted mold is of a precision mold by the special low melting point alloy, which is a faithful reproduction of the first model, and furthermore, since the final hard metal shell is also prepared by the ambient temperature metal spraying so as to faithfully reproduce the second model, the completed metal mold itself is very precise and accurate.

Incidentally, with respect to the overall strain or distortion which has been regarded as the largest defect in the metal mold utilizing sprayed metal layer as described above, the present invention has succeeded in providing the metal sprayed mold without any strain or distortion in such a manner that, prior to the back up of the hard metal shell 11, the mixture of sand and sodium silicate is filled in the concave space of said shell, into which mixture, carbon dioxide gas is blown for hardening so as to correctly maintain the configuration of the shell on the whole, with a subsequent application of the back up process. The metal molds according to the manufacturing method of the present invention are highly accurate, and fully correspond to metal molds produced by cutting metals.

Since the second model 7 according to the present invention may be produced in plurality from the low melting point metal shell 5, it is quite easy to prepare a plurality of metal molds of the same shape, with a further advantage from the viewpoint of time and economy in this case. Moreover, as is seen from the construction of the metal mold, since the inner face of the shell 11 is of the hard metal, with a rigid back up portion, the resultant metal mold is sufficiently durable. The metal spraying means of the present invention is based on the ordinary method, by preliminarily effecting pre-treatment such as sand blast or the like, through employment of a parting agent, etc.

As is seen from the foregoing description, the present invention provides a method capable of manufacturing metal molds superior in accuracy and durability quickly at low cost through repetition of extremely simple procedures.

Subsequently, based on the fundamental technique for the metal mold manufacturing method as described so far, a method of manufacturing metal molds having a still higher strength will be described hereinbelow.

As stated previously, the metal mold utilizing the metal melt-spraying is generally weak on the surface, and since pressures in the order of 500 to 1500 kg/cm$^2$ are applied to the surface of the metal mold, even when the metal mold is used as a metal mold for injection molding of plastic material, there are such disadvantages that the configurations and accuracy of the metal mold are not maintained, that cracks are formed, or particularly that the metal mold can not bear many shots i.e. repeated use due to loss of the parting line.

Although some of such disadvantages have been removed by the manufacturing method as described previously, a still more improved method which is superior in every aspect will be described hereinafter, with the metal mold being referred to as a second metal mold.

The fundamental technique for a method of manufacturing the second metal mold may be summarized as follows.

(i) A model is first made by an easily processable material such as wood, resin, gypsum, etc.

(ii) Based on the above model, an inverted mold of the model is prepared with the use of silicon rubber.

(iii) Subsequently, on the basis of the above inverted mold, a casting having the same shape as the model (referred to as a second model hereinbelow) is produced by the precision investment casting through employment of a low melting point metal which melts at 60° to 240° C. and has an extremely small expansion after solidification (for example, tin, antimony, bismuth, etc.). In this case, it is preferable to incorporate a cooling water pipe into the second model. The steps described so far are generally the same as in the fundamental manufacturing method described earlier.

(iv) On the surface of the above second model, many pins made of hard metal (for example, nickel alloy) are fixed or implanted by a suitable means (e.g. by such means as drilling holes in proper positions on the surface of the second model and then, inserting the pins of a hard metal thereinto for subsequent fixing by a bonding agent). The diameter of each pin should normally be in the range of 1 to 3 mm. After subjecting the second model on which the pins are implanted as described above, to blasting or bonding processing, hard metal with similar properties or of or the same kind as the pins is sprayed onto the second model, during which period, the second model is cooled. After forming the sprayed metal layer on the second model as described above, a mixture of silica sand and sodium silicate is further applied onto said layer, and by supplying $CO_2$ gas thereinto, the silica sand is hardened so as to form a reinforced portion of the sprayed metal layer.

(v) The structure obtained through the steps as described so far is placed in a furnace for heating up to a temperature at which the low melting point metal is melted so as to remove said second model through melting.

(vi) Subsequently, in a space formed by the removal of the second model, a mixture of silica sand and sodium silicate is filled, while $CO_2$ gas is supplied under pressure into the mixture for solidification thereof so as to form the reinforced portion of the hard metal layer. At this stage, both the cavity portion and the back face portion of the hardened metal sprayed layer are sandwiched by the hardened reinforcing material of silica sand for retaining the shape.

(vii) In the next step, the silica sand reinforced portion at the back of the sprayed metal layer is broken and removed and preliminarily prepared casting metal is poured into the portion previously occupied by the silica sand reinforced portion for integration with the sprayed metal layer. In the above case, a proper flux or the like is employed to improve the combining therebetween, while the cooling water pipe is embedded in the reinforced portion.

After spontaneous cooling of the casting metal, the hardened silica sand at the cavity portion is broken and removed, and further, portions of the pins extending outwardly from the hardened metal layer are cut off.

Figure 10:
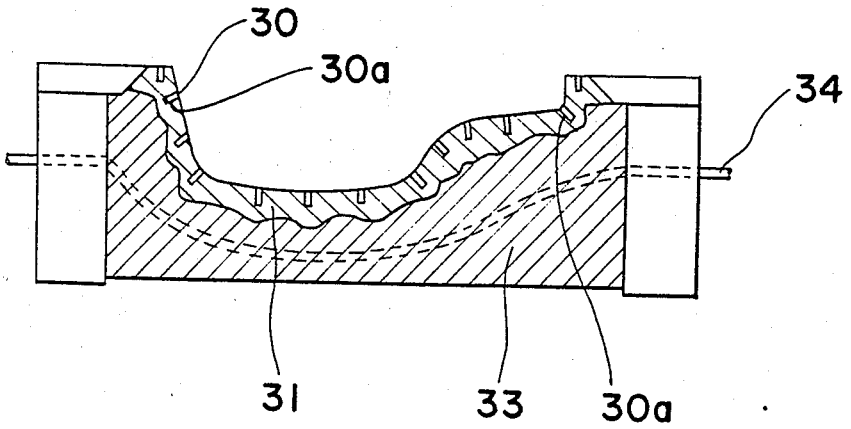
FIG. 10 is a side sectional view showing the state of the finished metal mold in the method of FIGS. 6 to 9.

Subsequently, the cavity surface thus formed is polished, and the metal mold is completed (FIG. 10).

In the case of a male mold also, the procedures for manufacturing are generally the same as above.

In another application of the method of manufacturing the second metal mold as described above, holes each having a diameter approximately three times that of the pin are formed in the first model made of a heat-resistant material (for example, gypsum), and after inserting the pins thereinto, the molten low melting point metal is poured into said holes for fixing the pins, an the model thus obtained is used as the pin implanted second model, to which hard metal with similar properties or of same kind as that of the pins is sprayed to produce the metal mold in the procedures similar to those as described so far.

The commonest method of manufacturing the second metal mold as described above will be explained hereinbelow with reference to the drawings.

(a) In the first place, a model is prepared by an easily processable material such as wood, resin (e.g. epoxy resin) or gypsum (FIG. 1), and based on this model, a precision inverted mold 3' is produced by a heat-resistant resin, for example, silicon rubber. In this case, as shown in FIG. 2, the model 1 is placed on the base 4, while it is surrounded by a frame 2, and silicon rubber is cast into the frame 2.

Figure 6:
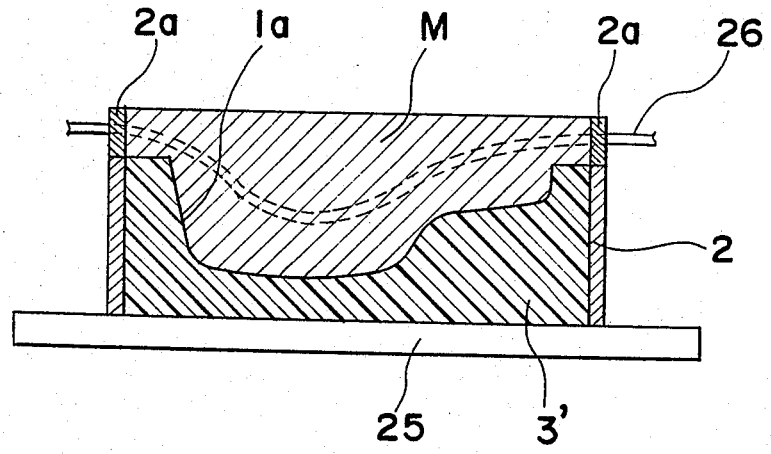
FIG. 6 is a side sectional view showing the state in which a low melting point metal is poured into a silicone resin inverted mold through a precision investment casting for a method according to another embodiment of the present invention.

(b) Subsequently, with employment of the above inverted mold 3', said inverted mold 3' is placed on a base 25 as shown in FIG. 6, and a tertiary or quaternary low melting point alloy selected, for example, from the group of a tin alloy, antimony, bismuth, etc. having melting points in the range of 60° to 240° C. and expansion after solidification less than 0.6/1000 is poured into the cavity 1*a* and frame walls 2*a* by the precision investment casting so as to form a casting mold having the same shape as the model 1, and referred to as a second model M hereinbelow. A cooling water pipe 26 is embedded in the second model M.

Figure 7:
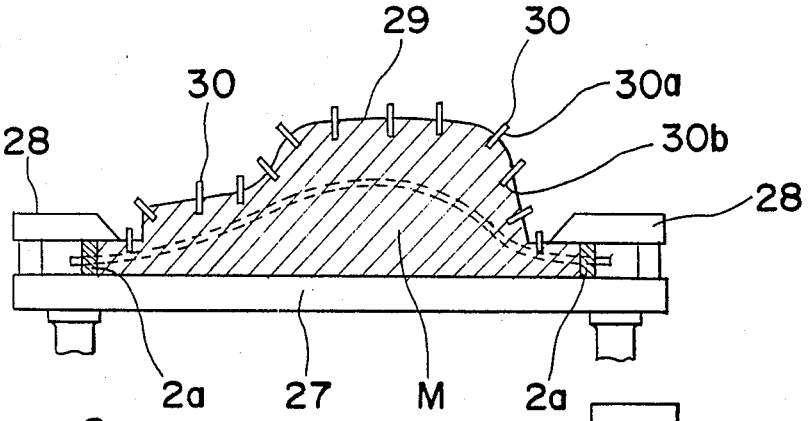
FIG. 7 is a side sectional view showing the state in which pins are secured or implanted onto the second model in the method of FIG. 6.

(c) After being subjected to processings such as polishing, etc. for sufficiently improving its accuracy, the second model M made of the low melting point metal is fixed on a base 27 by spacer blocks 28, and many short pieces of wire 30 (referred to as pins hereinafter) formed by a hard metal with a high melting point, for example, a nickel alloy (melting points in the range of 800° to 1200° C.) are fixed or implanted on the surface of the second model M (FIG. 7). For the fixing of the pins 30 on the second model M, holes are formed by drilling at proper positions of the second model M, and the pins 30 are respectively inserted into the holes, with an upper half 30*a* of each pin 30 projecting by a predetermined length from the surface of the second model M and a lower half 30*b* thereof being secured in the hole by a bonding agent and the like. For the pins 30, those having diameters in the range of about 1 to 3 mm are employed depending on sizes and end uses of the molds, while the number of pins 30 to be implanted is empirically determined by the character of the mold, and may normally be 0.2 to 1 piece per 1 $cm^2$. The pins should preferably have similar properties or be of the same kind as that for the hard sprayed metal to be described below, but may be of a metal with different properties.

Figure 8:
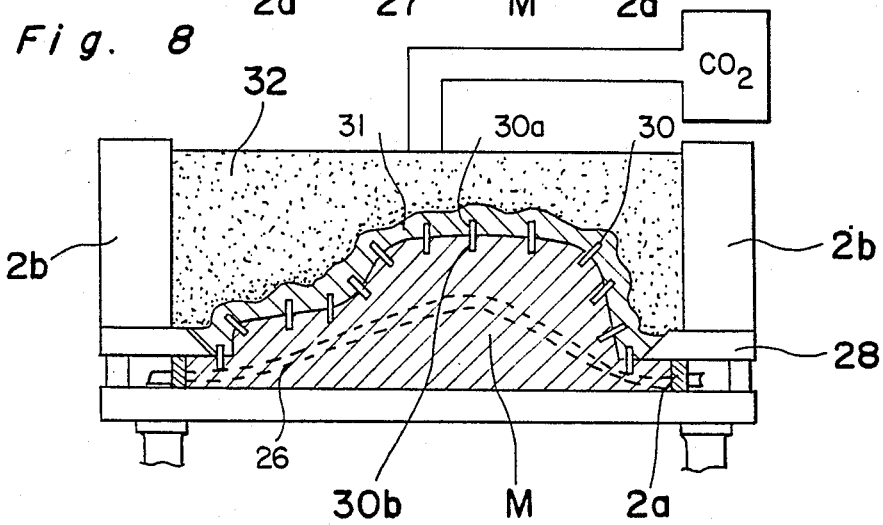
FIG. 8 is a side sectional view showing the state in which a hard metal sprayed layer is formed on the upper surface of the pin implanted second model of FIG. 7, with a silica reinforcing layer being further formed.

(d) After subjecting the entire second model M to which the pins are implanted as described above, to blasting or proper bonding processing, hard metal with similar properties or of the same kind as the pins 30, for example, a nickel alloy of 30% Ni, 4% Zn and 66% Cu is sprayed onto the second model to form the hard metal layer 31 as shown in FIG. 8, during which period, the second model should preferably be cooled by the cooling water. After forming the metal layer 31 on the second model M as described above, frames 2*b* are provided, and a mixture of silica sand and sodium silicate is further applied onto said layer 31, and thus, by supplying $CO_2$ gas under pressure thereinto, the silica sand is hardened for integration with the hard metal layer so as to form a reinforcing portion 32 for the hard metal layer 31.

(e) Subsequently, the entire structure thus obtained is heated in a furnace up to a temperature at which the low melting point metal is melted for removal of the second model M through melting. The reason for selecting the low melting point metal which melts in the temperature range of 60° to 240° C. is that other constituents are not adversely affected or damaged at all at temperatures in the above range. In the cavity after the second model has been removed, there are observed the projecting portions 30*b* of the pins 30 embedded in the hard metal layer 31 generally at the upper half portions 30*a* thereof, while, over the inner surface of said cavity, i.e. the surface 29 of the hard metal layer 31, the molten low melting point metal adheres in the form of a thin film, and also penetrates into fine spaces (sponge-like spaces) peculiar to the sprayed metal layer, although such spaces are present only to a slight depth in the surface layer of the sprayed metal layer.

Figure 9:
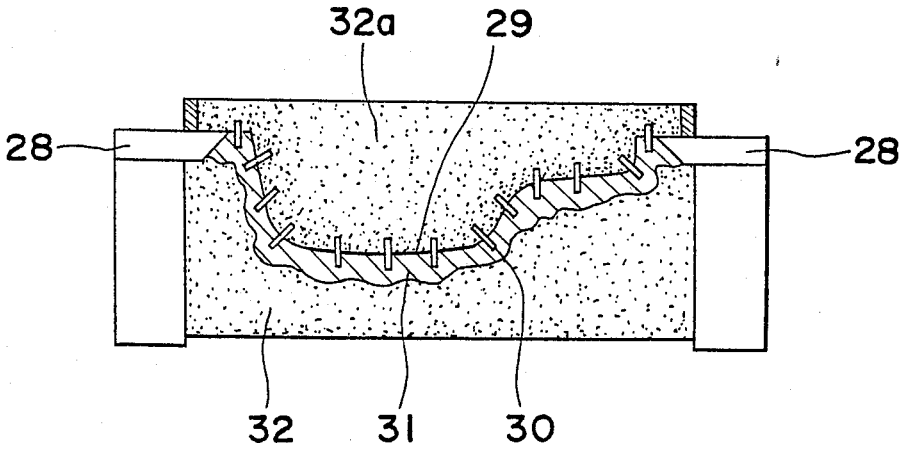
FIG. 9 is a side sectional view showing the state in which silica reinforced layers are formed on the upper and lower surfaces of the hard metal layer.

(f) Subsequently, in a space formed by the removal of the second model, a mixture of silica sand and sodium silicate is filled, while $CO_2$ gas is supplied under pressure into the mixture for solidification thereof so as to fill the cavity by the silica sand reinforced material 32*a* (FIG. 9). At this stage, the hard metal sprayed layer 31 is sandwiched, at its opposite surfaces, between the reinforced portion 32 and 32*a*.

(g) Finally, the silica sand reinforced portion 32 formed at the back of the sprayed hard metal layer 31 is broken and removed, and in place of this removed silica sand lump, a molten casting metal preliminarily prepared is poured so as to form a lining reinforced portion 33 which integrally combines the hard metal layer 31 and the frame 2*b*. In the above case, a cooling water pipe 34 is embedded in said reinforced portion (FIG. 10).

Thereafter, the silica sand reinforced portion 32*a* formed in the cavity of the hard metal layer 31 is broken and removed, and the portions 30*b* of the pins 30 projecting after the removal, with the half portions 30*a* of said pins embedded in the hard metal layer 31, are cut off, while the cavity surface is polished for finishing, and thus, metal molds having smooth mold faces are completed.

In the metal mold according to the present invention thus completed, the hard metal layer 31 forming the mold surface which is the main portion of the mold is composed of the sprayed hard metal layer reinforced by the hard metal pins, while during the removal of the second mold through melting, the thin film of the low melting point metal is formed on the surface of said hard metal layer, with part of the film penetrating into the fine spaces in said layer to present an appearance as in plating, and if such thin film is subjected to polishing, a mirror surface may be obtained. Thus, according to the present invention, metal molds superior in durability and accuracy are advantageously presented.

The method of manufacturing the second metal mold as described above is arranged to repeat the inverting operations of the model, without requiring processings such as cutting, electric casting, etc. and therefore, the time required up to the completion is reduced to a fraction of the time needed in the conventional metal mold manufacturing methods, with the configuration of the model being faithfully reproduced. Thus, the method according to the present invention not only has the merits of the so-called metal spraying system as it is, but also is provided with such features as the improved durability and removal of distortion.

It should be noted here that, in the foregoing embodiments, although the present invention has been mainly described with reference to female molds, a male mold may be obtained in exactly the same procedures as above by preparing a female mold for a starting mold.

Subsequently, a further applied embodiment of the present invention, in which the procedures for manufacturing the second metal mold have been simplified to a certain extent, will be described hereinbelow with reference to FIG. 11.

Figure 11:
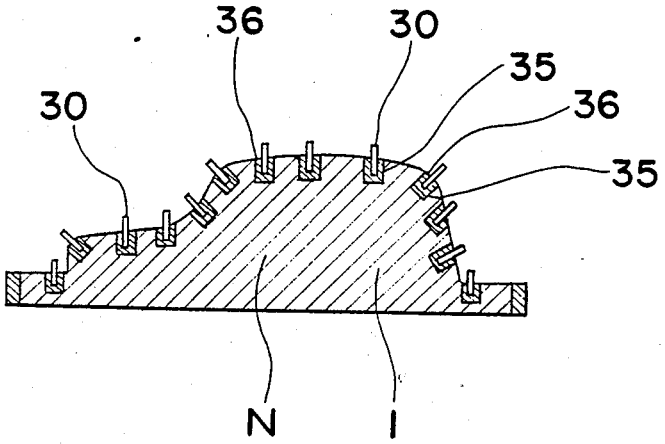
FIG. 11 is a side sectional view showing a model N for a method according to a further embodiment of the present invention.

In the method of FIG. 11, the starting model 1 is formed by a non-combustible material, for example, gypsum. In the first place, a predetermined number of holes 35 each having a diameter about three times that of the high melting point hard metal pins 30 are formed in the gypsum model by the predetermined number. After inserting the pins 30 into said holes 35, the molten low melting point metal 36 is poured into the holes 35 to fix the pins 30. The model N thus obtained to which the pins are implanted as described above, is used as the second model, and after subjecting the entire surface and particularly, the pins of this second model to blasting, with pre-treatment such as application of a parting agent thereto depending on necessity, hard metal with similar properties or of the same kind as the pins 30 is melt-sprayed to form the sprayed metal layer 31. Thereafter, the metal mold is completed through exactly the same process as in the fundamental technique described earlier. Thus, when the structure is heated, the metal 36 melts and the model N can be removed. The method as explained above may be extensively applied to cases where simple products, for example, plate-like articles are to be produced.

Moreover, the low melting point metal to be used in the present invention may be received in a vessel during removal through melting for re-use, while silica sand can also be re-used, and thus, the method of the present invention is superior from the economical point of view also.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A method of manufacturing metal molds by metal melt-spraying, which comprises the steps of:

spraying a first model with a first low melting point metal to form a hardened sprayed metal layer thereon;

removing said first model from said hardened sprayed metal layer;

casting a second low melting point metal into the space vacated by the removal of said first model to form a second model;

removing said second model;

spraying said second model with a high melting point metal to form a first mold;

melting said second model out of said first mold;

reinforcing the space vacated by the melting of the second mold with sand and reinforcing the space to the rear of the mold with metal, cement, or any suitable material; and removing said sand to obtain the final durable metal mold.

2. The method as recited in claim 1, wherein said first model is made of an easily processable material selected from the group consisting of wood, gypsum, and plastic.

3. The method as recited in claim 1, wherein the first low melting point metal is zinc, aluminum, or any alloy thereof.

4. The method as recited in claim 1, wherein the first low melting point metal and the high melting point metal are applied at ambient temperature.

5. The method as recited in claim 1, wherein the second low melting point metal is a member selected from the group consisting of tin, bismuth, and indium.

6. The method as recited in claim 1, wherein the high melting point metal is nickel or stainless steel.

7. The method as recited in claim 1, wherein the high melting point metal is sprayed onto said second model to a thickness of about 10 to 30 mm.

8. The method as recited in claim 1, wherein said second model is removed by melting the model at a temperature of 200° C.

9. The method as recited in claim 1, wherein the space to the rear side of the mold is reinforced with a member selected from the group consisting of cement, zinc, aluminum, and any alloy thereof.

10. The method as recited in claim 1, which further comprises polishing the concave face of said final metal mold after said sand has been removed.

11. A method of manufacturing durable metal molds by metal melt-spraying, which comprises the steps of:

placing a first model in a frame;

spraying a low melting point metal onto the surface of said model to form a hardened metal layer;

forming an inverted mold made of said metal layer by separating said model from said hardened metal layer;

pouring a molten low melting point metal into a concave portion of said inverted mold;

permitting the molten metal to cool and solidify;

separating the cooled and solidified metal from said inverted mold to form a second model;

fixing the second model on a metal surface plate;

surrounding the peripheral portion of said second model by a frame or mold base;

spraying a high melting point metal onto said second model to form a metal mold;

removing said second model from said mold by melting it to obtain a metal mold which is an integral structure with said frame or mold base;

filling a mixture of sand and sodium silicate into a concave spaced of said metal mold;

introducing carbon dioxide gas into said mixture to form a solid sand lump;

applying a supporting layer at the rear side of said integral structure;

embedding a cooling pipe in said supporting layer; and removing said solid sand lump from said concave space of said integral structure to obtain a final metal mold having a supporting layer.

12. A method of manufacturing metal molds by metal melt-spraying, which comprises the steps of:

covering the surface of a first model with heat-resistant resin to form a resin layer thereon;

removing said first model from said resin layer to form an inverted mold;

casting a low melting point metal into the space vacated by removal of said first model to thereby form a second model;

removing said second model from said resin layer;

implanting pins in said second model;

spraying the surface of said second model to form a hard metal layer on said second model;

applying a sand mixture to said hard metal layer;

melting said second model to form a mold;

filling the space vacated by the melting of said second model with a sand mixture;

removing the sand mixture applied to said hard metal layer;

pouring a molten casting metal in the space vacated by removal of the sand mixture applied to said hard metal layer; and removing the sand mixture previously filled in the space vacated by the melting of said second model to form the final metal mold product.

13. The method according to claim 12, wherein the heat-resistant resin is silicon rubber.

14. The method according to claim 12, wherein the low melting point metal has a melting point in the range of 60° to 240° C. and an expansion after solidification of less than 0.6/1000.

15. The method according to claim 12, wherein a first pipe for cooling water is placed into the space vacated by removal of said first model.

16. The method according to claim 12, wherein the pins have a melting point in the range of 800°-1200° C.

17. The method according to claim 12, wherein the sand mixture applied to said hard metal layer is hardened by directing carbon dioxide gas into said sand mixture.

18. The method according to claim 12, wherein a second pipe for cooling water is placed in the space vacated by removal of the sand mixture applied to said hard metal layer.

19. A method of manufacturing metal molds by melt spraying, which comprises the steps of:

forming holes in a model made of a non-combustible material;

inserting pins in said holes;

pouring a low melting point metal into said holes to fix said pins to said model;

spraying the surface of said model with a hard metal to form a hard metal layer;

applying a sand mixture to said hard metal layer;

removing said model to form a mold of said hard metal layer by melting the low melting metal disposed in said holes;

filling the space vacated by the removal of the model with a sand mixture;

removing the sand mixture applied to said hard metal layer;

pouring a molten casting metal in the space vacated by removal of the sand mixture which was previously applied to said hard metal layer; and removing the sand mixture previously introduced in the space vacated by removal of the model to form a final metal mold product.

* * * * *